US007137220B1

(12) United States Patent
Bradley, Jr.

(10) Patent No.: US 7,137,220 B1
(45) Date of Patent: Nov. 21, 2006

(54) SCOPE AND TRIGGER SYSTEM FOR A RIFLE

(76) Inventor: Edward P. Bradley, Jr., 14514 State Highway 20 West, Niceville, FL (US) 32578

( * ) Notice: Subject to any disclaimer, the term of this patent is extended or adjusted under 35 U.S.C. 154(b) by 0 days.

(21) Appl. No.: 11/360,786

(22) Filed: Feb. 22, 2006

(51) Int. Cl.
*F41G 1/38* (2006.01)

(52) U.S. Cl. ..... 42/119; 42/118; 356/254

(58) Field of Classification Search ..... 42/118–119; 356/254

See application file for complete search history.

(56) References Cited

U.S. PATENT DOCUMENTS

| | | | | |
|---|---|---|---|---|
| 694,904 | A | 3/1902 | Youlten | |
| 880,378 | A | 2/1908 | Geis | |
| 1,084,848 | A | 1/1914 | Demele | |
| 1,176,893 | A | 3/1916 | Hartney | |
| 1,184,078 | A | 5/1916 | Cooke | |
| 1,260,285 | A | 3/1918 | Cordell | |
| 1,264,133 | A | 4/1918 | Morris | |
| 1,269,178 | A | 6/1918 | Hamilton | |
| 1,300,688 | A * | 4/1919 | Bellard | 42/118 |
| 1,386,247 | A * | 8/1921 | Fordyce | 42/118 |
| 2,311,186 | A | 2/1943 | Lobdell | |
| 2,391,659 | A | 12/1945 | Trafford | |
| 2,627,132 | A | 2/1953 | Dolgacius | |
| 2,746,369 | A * | 5/1956 | Beard et al. | 396/420 |
| 3,405,469 | A | 10/1968 | Francois | |
| 3,498,691 | A | 3/1970 | Razdow | |
| 3,861,803 | A | 1/1975 | Sallans | |
| 3,863,354 | A | 2/1975 | Karppinen | |
| 4,390,276 | A | 6/1983 | Budden et al. | |
| 4,878,305 | A * | 11/1989 | Gabrielidis | 42/72 |
| D398,035 | S * | 9/1998 | Rowe | D22/103 |
| 6,311,424 | B1 | 11/2001 | Burke | |
| 6,604,316 | B1 | 8/2003 | Custer | |
| 6,643,969 | B1 | 11/2003 | Avizonis, Jr. | |
| 6,715,227 | B1 | 4/2004 | Swain | |

* cited by examiner

*Primary Examiner*—Michael J. Carone
(74) *Attorney, Agent, or Firm*—Peter Loffler

(57) ABSTRACT

A collimating scope for attachment to a rifle such that the scope has an objective lens that is positioned above the barrel of the rifle and an ocular lens that is below the barrel of the rifle and that is proximate the opening of the barrel. A grip extends downwardly from the scope and has a trigger thereon that is mechanically connected to the trigger of the rifle for firing the rifle from the trigger on the grip. A pair of braces are provided, one for the torso of a user, the other for a thigh of the user in order to rest the scope and its attached rifle on the back of a user so that the user may lie prone and below the rifle and be able to scope a target and fire the rifle from this position.

19 Claims, 2 Drawing Sheets

SCOPE AND TRIGGER SYSTEM FOR A RIFLE

BACKGROUND OF THE INVENTION

1. Field of the Invention

The present invention relates to a collimated scope for attachment to a rifle wherein the ocular lens of the scope is located below barrel of the rifle upon which the scope is installed and wherein the invention has a trigger actuator that connects to the trigger of the rifle wherein the trigger actuator allows a user to fire the rifle proximate the front of and below the barrel of the rifle.

2. Background of the Prior Art

The business of sniping is a lonely and deadly affair. Oftentimes, a sniper will lie in wait for hours or even days at a time waiting for his quarry to happen along. One of the fundamental characteristics of this profession is the need for complete secrecy. Staying stealthy helps prevent the discovery of the sniper by the target and other bad guys and also helps protect the sniper once his presence is discovered by the discharge of his weapon and return fire is commenced. In order to remain out of view, snipers stay low in brush and are oftentimes camouflaged so as to blend in with the natural surroundings. Additionally, a sniper tries to put substantial distance between himself and the anticipated strike area of the target. In this way, should return fire be commenced, a relatively large distance between the enemy and the sniper renders the return fire substantially less accurate than at close range. Additionally, by being far away from the enemy, the enemy will have difficulty determining from whereat the incoming shot originated. As the sniper has the skill and the time to line up a shot as well as a long-range precision weapon, the relatively large firing distance is not a major obstacle.

Even with the above precautions, the sniper is not completely safe. The enemy returning fire may see just enough of a muzzle flash from the rifle or may get lucky and see the scope of the rifle and aim toward the anticipated barrel of the rifle in hopes of hitting the sniper located therebehind. A relatively inaccurate weapon may still find its way to its mark.

Therefore, in order to further protect a sniper from being hit by return fire, it is desirable to get the sniper out from behind the scope and barrel, as that is the location where return fire will be directed if the sniper's location is discovered. Ideally, the sniper needs to be sufficiently underneath the scope and barrel so that should his scope and weapon be seen, directed fire at the scope and weapon will not strike the sniper.

SUMMARY OF THE INVENTION

The scope and trigger system for a rifle of the present invention addresses the aforementioned needs in the art by providing an apparatus that allows a sniper to be located underneath the weapon and to fire the weapon from this location. Additionally, the scope can extend substantially further back along the length of the weapon relative to standard scopes in order to give a much greater focal length for the scope thereby improving the effectiveness of the scope. This is all achieved without worries about rifle balance.

The scope and trigger system for a rifle of the present invention is attached to a rifle that has a body, a barrel extending forwardly from the body, a stock extending rearwardly from the body, a grip encompassing a portion of the barrel, a barrel rail located on an upper surface of the body, and a rifle trigger extending downward from the body for firing the rifle by squeezing the rifle trigger. The scope and trigger system for a rifle comprises a collimating scope that has a first straight leg with an objective lens, a second straight leg that is generally parallel with the first straight leg and with an ocular lens, and a diagonal leg that connects the first straight leg with the second straight leg. The objective lens and the ocular lens are in light communication with one another. The first straight leg is connected to the barrel rail and is positioned above the barrel of the rifle and the second straight leg is located below the barrel of the rifle whenever the scope is attached to the barrel rail. A hand grip extends down from the scope. A trigger is pivotally attached to the hand grip. A linkage is attached to the scope and to the trigger such that squeezing of the trigger causes the linkage to squeeze the rifle trigger. The linkage comprises a lever that is pivotally attached to the scope and a cable that connects the trigger with the linkage such that the lever is positioned to touch the rifle trigger and wherein squeezing of the trigger causes pulling on the cable which causes the lever to pivot toward the rifle trigger and squeeze the trifle trigger. The cable has a tensioning turnbuckle. A torso brace is attached to the grip and that extends downwardly therefrom. The torso brace has a first body member that receives a torso of a person. A shoulder hook that extends outwardly from the first body member and lies across a shoulder of the person. The first body member pivots with respect to the grip. A thigh brace is attached to the stock and extends downwardly therefrom. The thigh brace has a second body member that receives a thigh of the person. The second body member pivots with respect to the stock. The first straight leg is longer than the second straight leg.

BRIEF DESCRIPTION OF THE DRAWINGS

Similar reference numerals refer to similar parts throughout the several views of the drawings.

DESCRIPTION OF THE PREFERRED EMBODIMENT

Figure 1:
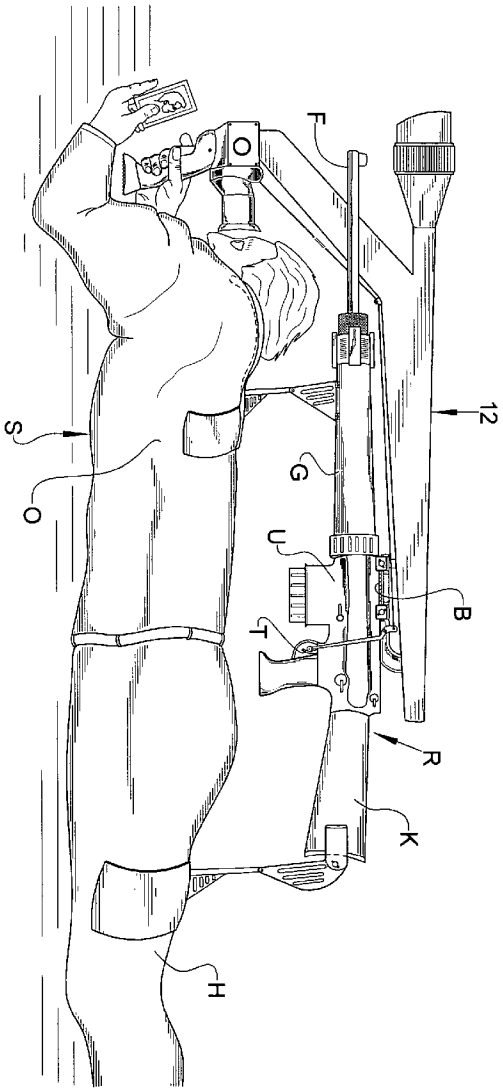
FIG. 1 is an environmental view of the scope and trigger system for a rifle of the present invention being used by a sniper.
Figures 2, 3, 4:
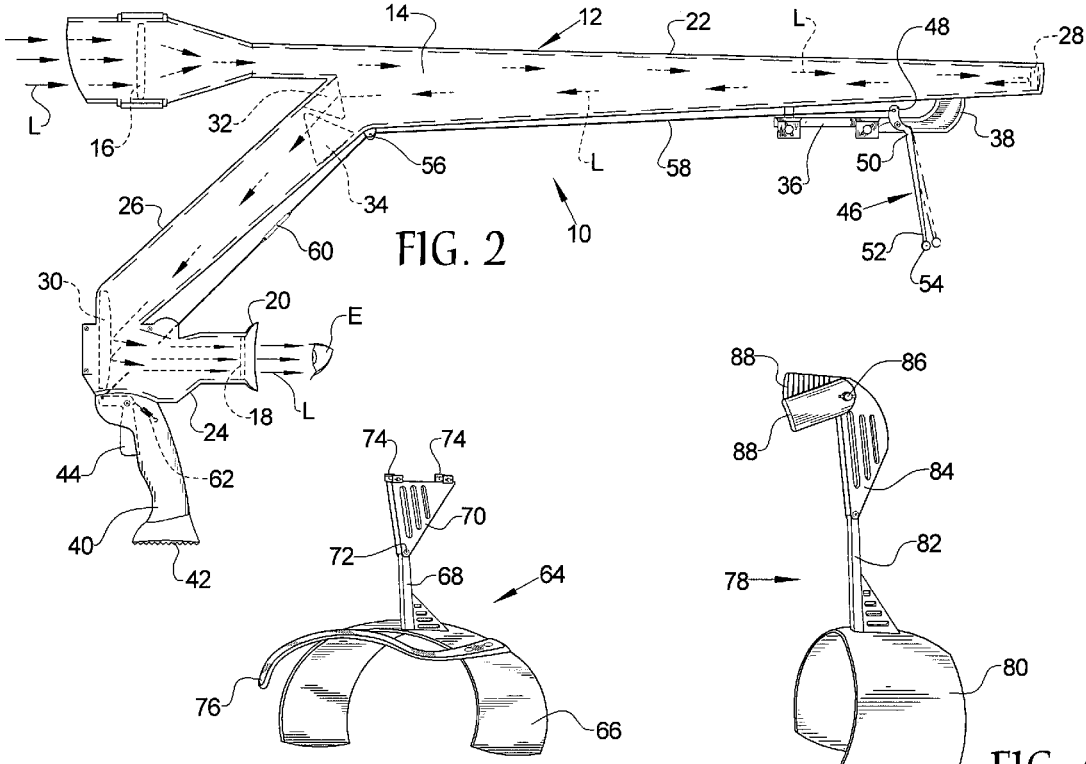
FIG. 2 is an elevation view of the scope and trigger system for a rifle.
FIG. 3 is a perspective view of the torso brace used with the scope and trigger system for a rifle.
FIG. 4 is a perspective view of the thigh brace used with the scope and trigger system for a rifle.

Referring now to the drawings, it is seen that the scope and trigger system for a rifle of the present invention, generally denoted by reference numeral 10, is comprised of a collimating scope 12 that has a body 14 with an objective lens 16 and an ocular lens 18 having an eye piece 20 proximate thereto. As seen, the body 14 has an upper straight leg 22 and a relatively short lower straight leg 24 that are joined by a diagonal leg 26. A first mirror 28 is located at the back of the upper straight leg 22 (opposite the objective lens 16) and a second mirror 30 is located at the juncture of the lower straight leg 24 with the diagonal leg 26. A first prism 32 is attached to the forward surface of the diagonal leg 26 at the juncture of the diagonal leg 26 with the upper straight leg 22. A second prism 34 is attached to the rearward surface of the diagonal leg 26 just below the first prism 32. The scope 12 works in standard fashion. Light L enters the scope 12 through the objective lens 16 and travels through the upper straight leg 22 and is reflected by the first mirror 28 toward the first prism 32, the first prism 32 redirects the light L to the second prism 34 which directs the light L to the second mirror 30, which reflects the light L to the eye E of the user S through the ocular lens 18. Appropriate focus means are provided on the scope.

A sight mounting clamp 36 extends downwardly from the upper straight leg 22 and is secured directly to the body 14 at its forward end and is attached to the body 14 by a bracket 38 at its rearward end.

Extending downwardly from the lower straight leg 24 is a hand grip 40 with a non-slip foot 42. A trigger 44 is attached to the hand grip 40. A trigger lever 46 has an upper end 48, a medial portion 50, and a lower end 52 with a roller 54 thereon, the trigger lever 46 is pivotally attached to the bracket 38 at its medial portion 50 just below its upper end 48. A pulley 56 is attached to the body 14 at the juncture of the upper straight leg 22 and the diagonal leg 26. A cable 58 extends between the trigger 44 and the upper end 48 of the trigger lever 46, such that squeezing the trigger 44 pulls on the cable 58 which causes the upper end 48 of the trigger lever 46 to be pulled forward and thus the lower end 52 to pivot backward. A tensioning turnbuckle 60 keeps the cable 58 in proper tension. A return spring 62 is attached to the hand grip 40 and to the trigger 44 in order to keep the trigger 44 in a normally tensioned state.

A torso or thoracic brace 64 is provided and has a generally U-shaped body member 66 and a standard 68 extending upwardly therefrom. A connection arm 70 is pivotally attached to the standard 68 and has a tensioning adjustment screw 72. A pair of rifle gripping clamps 74 (or other appropriate rifle attachment means) is provided in order to secure the torso brace 64 to a rifle R. A shoulder hook 76, which is curved, extends outwardly from the body member 66.

A thigh brace 78 is provided and has a generally U-shaped body member 80 and a standard 82 extending upwardly therefrom. A connection arm 84 is pivotally attached to the standard 82 and has a tensioning adjustment screw 86. A pair of stock gripping clamps 88 (or other appropriate rifle stock attachment means) is provided in order to secure the thigh brace 78 to the stock K of a rifle R.

In order to use the scope and trigger system for a rifle of the present invention 10, the scope 12 is attached to the barrel rail B of the rifle R that is located on the upper surface of the body U of the rifle and secured thereto in standard fashion. The scope 12 is positioned so that the roller 54 of the trigger lever 46 just touches the rifle trigger T of the rifle R whenever the trigger 44 of the scope and trigger system for a rifle 10 is in its normally tensioned state. The torso brace 64 is attached to the grip G of the rifle and secured thereto in any desired fashion such as by screwing the gripping clamps 74 in order to clamp the torso brace 64 to the grip G. Similarly, the thigh brace 78 is attached to the back end of the stock K of the rifle R.

The user S lies down in a generally prone position and positions the scope and trigger system for a rifle 10 such that the body member 80 of the thigh brace 78 receives one of the thighs H of the user S while the torso brace 64 receives the torso O of the user S. The shoulder hook 76 rests along a shoulder of the user. The tensioning adjustment screw 72 on the torso brace 64 as well as the tensioning adjustment screw 86 on the thigh brace 78 are adjusted as needed in order to provide a proper and comfortable fit of the scope and trigger system for a rifle 10 upon the user. The user S looks through the eye piece 20 of the scope 12 in order to acquire a desired target. Upon seeing the target, the user S squeezes the trigger 44 of the scope and trigger system for a rifle 10 which transfers the squeezing force, via the cable 58 in order to move the lower end 52 of the trigger lever 46 backwards and act upon the rifle trigger T of the rifle R thereby squeezing the rifle trigger T of the rifle R and firing the rifle R. When the user S releases the trigger 44 on the hand grip 40, the return spring 62 returns the trigger 44 back to its normally tensioned state. As this happens, the rifle trigger T of the rifle R returns back to its normal state, causing the trigger lever 46 to pivot in reverse fashion relative to the firing pivot. The roller 54 on the trigger lever 46 helps assure smooth interaction between the trigger lever 46 and the rifle trigger T of the rifle.

The ocular lens 18 and the eye piece 20 of the scope 12 are below the barrel F of the rifle R in a normally positioned rifle R. This helps keep the head of the user S below the barrel F and helps keep him out of harms way. The trigger 44 by being below the normal rifle trigger T also allows the user S to stay very low and safer. As the collimating scope 12 has a very long focal length, due to its being able to extend along a substantial portion of the rifle R, the scope 12 can be used very accurately at great distances. The torso brace 64 along with the shoulder hook 76 and the thigh brace 78 keep the rifle R very steady irrespective of any imbalance the unusually long scope 12 may introduce. This eliminates the need for a tripod thereby helping keep the sniper S confined with a relatively small real estate foot print and less likely to be seen.

While the invention has been particularly shown and described with reference to an embodiment thereof, it will be appreciated by those skilled in the art that various changes in form and detail may be made without departing from the spirit and scope of the invention.

I claim:

1. A attachment for a rifle, the rifle having a body, a barrel extending forwardly from the body, a stock extending rearwardly from the body, a grip encompassing a portion of the barrel, a barrel rail located on an upper surface of the body, and a rifle trigger extending downward from the body for firing the rifle by squeezing the rifle trigger, the attachment comprising;

a scope adapted to attach to the barrel rail, the scope having an objective lens and an ocular lens that is light connected with the objective lens such that the objective lens is located above the barrel of the rifle and the ocular lens is located below the barrel of the rifle whenever the scope is attached to the barrel rail;

a hand grip extending down from the scope;

a grip trigger pivotally attached to the hand grip;

a linkage attached to the scope and to triggers such that squeezing of the grip trigger causes the linkage to squeeze the rifle trigger.

2. The attachment as in claim 1 wherein the linkage comprises:

a lever that is pivotally attached to the scope;

a cable that connects triggers with the linkage; and wherein the lever is positioned to touch the rifle trigger and wherein squeezing of the grip trigger causes pulling on the cable which causes the lever to pivot toward the rifle trigger and squeeze the rifle trigger.

3. The attachment as in claim 1 wherein the cable has a tensioning turnbuckle.

4. The attachment as in claim 1 further comprising a torso brace that is adapted to be attached to the grip and that extends downwardly therefrom, the torso brace having a first body member that is adapted to receive a torso of a person.

5. The attachment as in claim 4 further comprising a shoulder hook that extends outwardly from the first body member, the shoulder hook adapted to lie across a shoulder of the person.

6. The attachment as in claim 4 wherein the first body member pivots with respect to the grip.

7. The attachment as in claim 4 further comprising a thigh brace that is adapted to be attached to the stock and that extends downwardly therefrom, the thigh brace having a second body member that is adapted to receive a thigh of the person.

8. The attachment as in claim 7 wherein the second body member pivots with respect to the stock.

9. The attachment as in claim 1 in combination with the rifle.

10. An attachment for a rifle, the rifle having a body, a barrel extending forwardly from the body, a stock extending rearwardly from the body a grip, encompassing a portion of the barrel, a barrel rail located on an upper surface of the body, and a rifle trigger extending downward from the body for firing the rifle by squeezing the rifle trigger, the attachment comprising;

a scope having a first straight leg having an objective lens, a second straight leg that is generally parallel with the first straight leg and having an ocular lens, and a diagonal leg that connects the first straight leg with the second straight leg such that the objective lens and the ocular lens are in light communication and such that the first straight leg is connected to the barrel rail and is positioned above the barrel of the rifle and the second straight leg is located below the barrel of the rifle whenever the scope is attached to the barrel rail;

a hand grip extending down from the scope;

a grip trigger pivotally attached to the hand grip;

a linkage attached to the scope and to triggers such that squeezing of the grip trigger causes the linkage to squeeze the rifle trigger.

11. The attachment as in claim 10 wherein the linkage comprises:

a lever that is pivotally attached to the scope;

a cable that connects triggers with the linkage; and wherein the lever is positioned to touch the rifle trigger and wherein squeezing of the grip trigger causes pulling on the cable which causes the lever to pivot toward the rifle trigger and squeeze the rifle trigger.

12. The attachment as in claim 10 wherein the cable has a tensioning turnbuckle.

13. The attachment as in claim 10 further comprising a torso brace that is adapted to be attached to the grip and that extends downwardly therefrom, the torso brace having a first body member that is adapted to receive a torso of a person.

14. The attachment as in claim 13 further comprising a shoulder hook that extends outwardly from the first body member, the shoulder hook adapted to lie across a shoulder of the person.

15. The attachment as in claim 13 wherein the first body member pivots with respect to the grip.

16. The attachment as in claim 13 further comprising a thigh brace that is adapted to be attached to the stock and that extends downwardly therefrom, the thigh brace having a second body member that is adapted to receive a thigh of the person.

17. The attachment as in claim 16 wherein the second body member pivots with respect to the stock.

18. The attachment as in claim 10 wherein the first straight leg is longer than the second straight leg.

19. The attachment as in claim 10 in combination with the rifle.

* * * * *